US006065253A

United States Patent [19]

Ojeda

[11] Patent Number: 6,065,253

[45] Date of Patent: May 23, 2000

[54] PLAYHOUSE KIT

[76] Inventor: Rosa Ojeda, Rte. 1, Box 541B Tepee Trail, Hockley, Tex. 77447

[21] Appl. No.: 09/168,576

[22] Filed: Oct. 8, 1998

[51] Int. Cl.[7] ..... E04H 14/00; A63H 33/26; A63H 3/52

[52] U.S. Cl. ..... 52/79.9; 52/64; 52/DIG. 4; 52/DIG. 13; 446/131; 446/139; 446/478

[58] Field of Search ..... 52/79.9, 79.1, 52/64, DIG. 4, DIG. 13; 446/476, 478, 131, 139

[56] References Cited

U.S. PATENT DOCUMENTS

| | | | |
|---|---|---|---|
| 2,020,196 | 11/1935 | Mallgraf . | |
| 3,231,942 | 2/1966 | O'brien . | |
| 4,467,572 | 8/1984 | Somers et al. . | |
| 4,603,658 | 8/1986 | Gainsey . | |
| 4,964,249 | 10/1990 | Payne . | |
| 5,120,262 | 6/1992 | Caine | 446/476 |
| 5,178,573 | 1/1993 | Smith | 446/137 |
| 5,301,478 | 4/1994 | Maese, Jr. . | |
| 5,313,747 | 5/1994 | Sakihara . | |
| 5,890,338 | 4/1999 | Rodriguez-Ferre | 52/582.1 |

*Primary Examiner*—Carl D. Friedman
*Assistant Examiner*—Yvonne Horton-Richardson
*Attorney, Agent, or Firm*—Joseph N. Breaux

[57] ABSTRACT

A playhouse kit which includes a building constructed of thin light weight materials with dry eraser surfaces provided on both the interior and exterior surfaces thereof. The building is constructed using members forming walls, roof, and floor of a house shape structure while the members to construct the house are attached to each other utilizing Velcro™ or any other securable attachment means. Numerous magnetically attachable accessories are provided including thematic accessories and/or any accessories which would may interest the child's imagination. In addition to the accessories numerous dry eraser markers in various colors are provided that allows the child to draw on or decorate the interior or exterior surfaces of the playhouse as desired.

2 Claims, 2 Drawing Sheets

PLAYHOUSE KIT

TECHNICAL FIELD

The present invention relates to devices and methods for playhouses and more particularly to devices and methods for a playhouse kit that comprises a building constructed of thin light weight magnetic materials with dry erase surfaces provided on the interior and the exterior thereof and configured to resemble a house shaped structure. A number of magnetically attachable playhouse accessory items including a light bulb, radio, furniture, and any other item that may be used by the child to attach to the house, and numerous marking pens in various colors.

BACKGROUND ART

There have been numerous doll houses and playhouses designed for children to help instruct children about house arrangements and to assist in imagination development of children. Although these prior art devices are useful for there stated purposes there has never been a playhouse kit as the present which allows the child to express his/her imagination by marking on the interior and exterior surfaces of the playhouse, disassembling the playhouse, and placing accessory items on different locations of the playhouse as desired. The present invention provides a useful means of allowing a child's imagination to be exercised along with improving a child's manual dexterity.

The prior art patents which are relevant are as follows:

Sakihara, U.S. Pat. No. 5,313,747; Maese, Jr., U.S. Pat. No. 5,301,478; Payne, U.S. Pat. No. 4,964,249; O'Bryan, U.S. Pat. No. 3,231,942; Garnsey, U.S. Pat. No. 4,603,658; Somers, et al, U.S. Pat. No. 4,467,572.

As will be shown below, the present invention provides a useful playhouse kit that allows a child to mark on the playhouse surfaces either interiorly or exteriorly of the house while also providing house which can be constructed by the child and also providing numerous accessories which may be magnetically attached to either the interior or exterior surfaces of the house as desired by the child in order to help effectuate improved imagination for the child.

GENERAL SUMMARY DISCUSSION OF INVENTION

It is thus an object of the invention to provide a playhouse kit that includes a building constructed of thin light weight magnetic materials with dry erasable surfaces provided on the interior and exterior surfaces thereof.

It is a further object of the invention to provide a playhouse kit that includes numerous house construction members which are constructed and arranged in a configuration to resemble a house shape structure and further wherein the separate members are securable to each other using Velcro$_{TM}$ strips.

It is a still further object of the invention to provide a playhouse kit that includes numerous marking pens in various colors for marking on dry eraser surfaces of the interior and exterior of the material comprising the house.

It is a still further object of the invention to provide a playhouse kit that includes numerous magnetic accessories which are attachable by the child on any location of the house as desired.

Accordingly, a playhouse kit is provided which includes a building constructed of thin light weight magnetic materials with dry eraser surfaces provided on the interior and exterior thereof that form house construction members that are arranged and assembled in a configuration to resemble a house shaped structure and further wherein magnetically attachable accessories are used by the child to attach on various locations of the house as desired and wherein numerous dry eraser markers in numerous colors are provided for allowing the child to decorate the interior and exterior of the playhouse. Additionally, a flexible magnetic sheet is provided in a variety of decorations on one surface so that the child may change the surface appearance of the house wall members thereof.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that a child's imagination will be greatly enhanced by the use of the playhouse kit as described herein. The child would simply assemble the home using the construction house members including walls, floor, and roof and attach the components together using Velcro$_{TM}$ strips provided thereon. The child's would then enjoy the benefits of having an extremely versatile playhouse which could be decorated using numerous magnetic accessories which may be attached to any location either on the interior or exterior of the house. Additionally, the child may be able to decorate by drawing or writing on any location of the walls, floor, or roof using the numerous eraser marking pens provided with the kit. The child may also utilize magnetic wall paper to change the appearance of the interior of the house or may also attach the wall paper to the exterior as desired by his/her own imagination. Seasonal thematic decorations may also be provided such as Christmas trees, reindeer, Santa Claus, presents, snow, or any other magnetic accessories which may be attachable to the house by the child.

Figure 1:
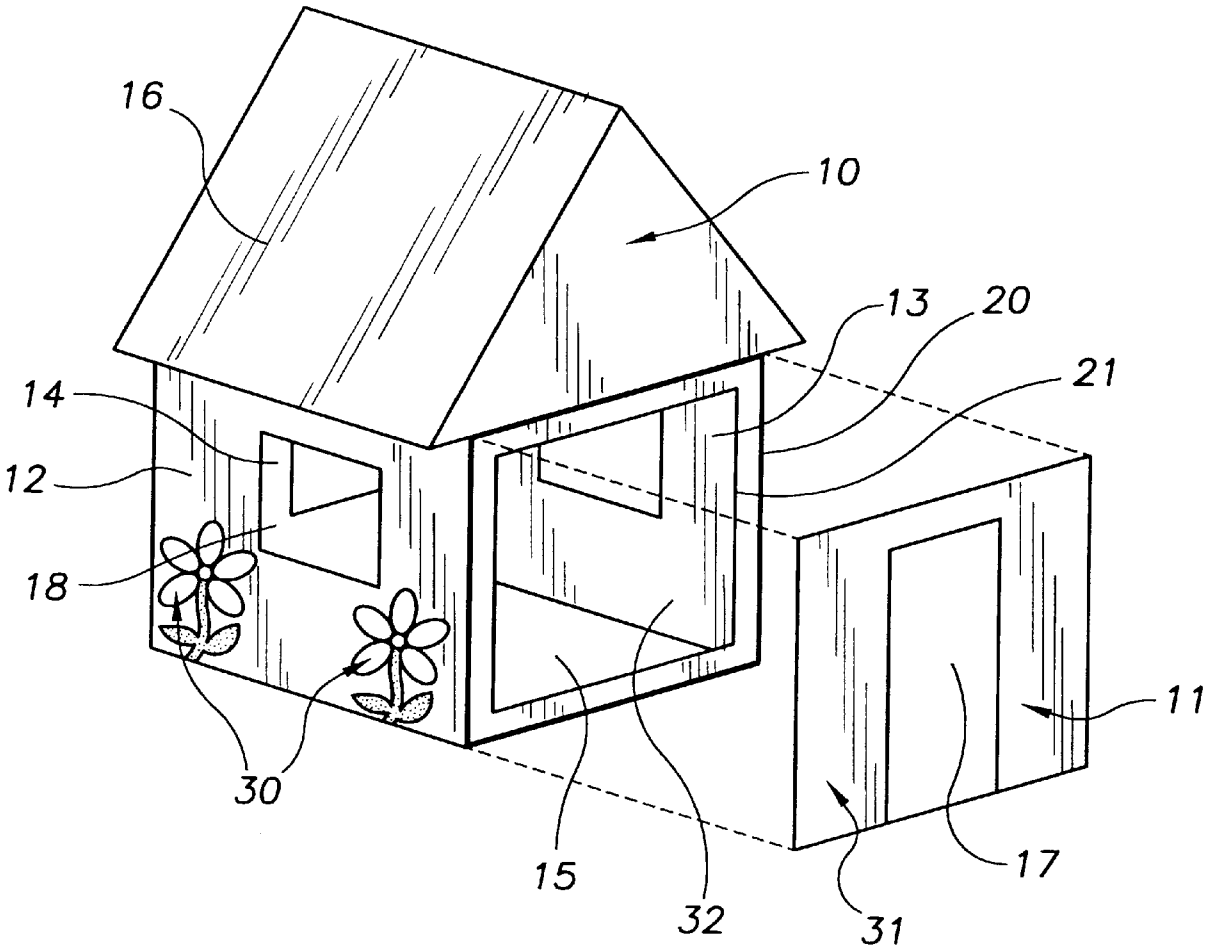
FIG. 1 is an isometric view of the playhouse constructed showing the attachment walls with a doorway positioned therethrough.

Referring to the figures in detail FIG. 1 is an isometric view of the house 10 assembled using four walls 11, 12, 13 and 14, a floor member 15 and a roof 16. Velcro$_{TM}$ strips 20 are provided on a perimeter of the walls edges 21 and provide a means for attaching the wall members floor and roof together. Wall member 11 includes a door passage way 17 while the other wall members 12, 13 and 14 include window openings 18. When assembling the house, the child will first lay the floor flat on a surface and attach the wall members by forming perimeter walls thereon. The roof assembly would then be laid on top of the assembled walls. Magnetic accessories 30 are then attachable to either the exterior 31 or interior 32 of the house surfaces.

Figure 2:
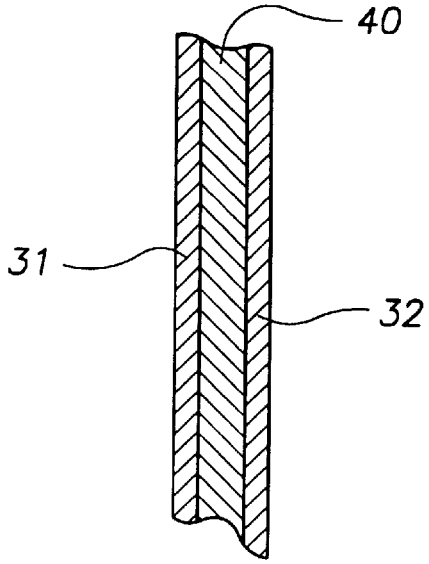
FIG. 2 is a cross section of light weight magnetic material comprising the construction of the wall and other members of the house which includes dry erase surfaces on both the interior and exterior surfaces.

FIG. 2 illustrates a cross section of the material used to construct the walls, floor, and roof of the house. The material includes a metallic inner core and an interior surface 32 and an exterior surface 31 that is a polymer coating which resists marking and is preferably a dry erase surface so that the markers provided with the kit do not permanently mark the surfaces. These surfaces provide a means for allowing a child to mark on the house in any location and quickly erase the markings if desired.

Figure 3:
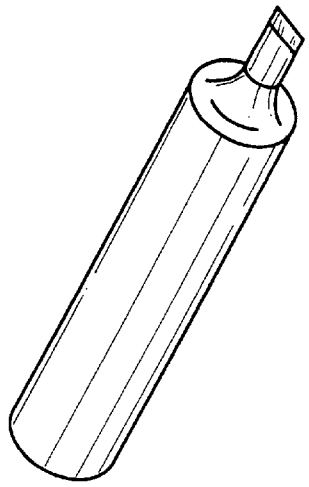
FIG. 3 is an erasable marker provided in numerous colors with the playhouse kit.

FIG. 3 illustrates a dry erase marker which would preferably be provided in numerous colors so that the child may draw or mark on the house utilizing colors as desired.

Figure 4:
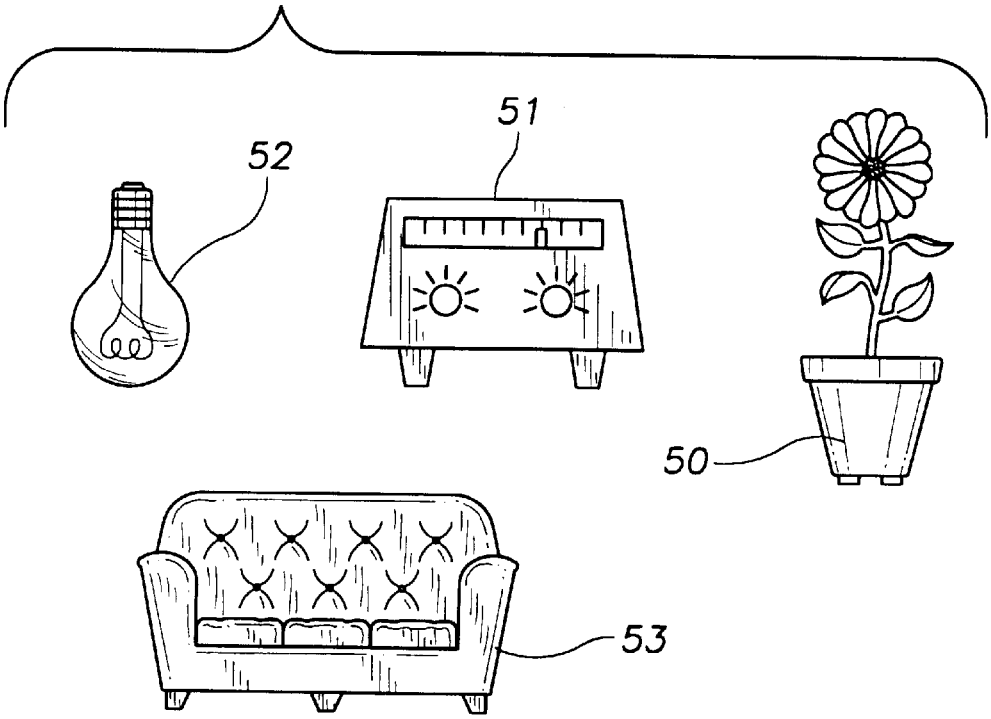
FIG. 4 is an assortment of accessories including a couch, a light bulb, radio, and a flower pot which are magnetic members attachable to any location of the house.

FIG. 4 illustrates numerous accessory items which are constructed of the identical materials as illustrated in FIG. 2 however the materials are cut into shapes to resemble a given item such as a flower pot 50, a radio 51, a light bulb 52, or a couch 53. The illustrations and description for the number and types of accessories which may be provided with this kit are not to be construed as limiting. The kit may be provided with accessories which may be thematic such as Christmas accessories including Christmas trees, reindeers, Santa Claus, snow, presents, ornaments, or any other Christmas type accessory.

A simulated wall paper material may also be provided which are dimensioned and shaped to fit on a wall surface of the house. One surface of the wall paper is decorative so that a child may attach the paper to the house to change the house appearance if desired.

It is noted that the embodiment of the Playhouse Kit described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A playhouse kit comprising:

a) a house structure comprising numerous house construction members including a floor member, four wall members, and a roof member, the wall members include a window and door apertures the construction members are constructed using thin light weight flat magnetic material with a marker erasable surface on each flat side thereof, and attachable to each other along edges fitted with an attachment means, b) numerous magnetic accessories constructed of thin light weight flat magnetic material and with a marker erasable coating on each flat side thereof, further wherein the accessories are shaped to resemble decorative or thematic articles so that a child may magnetically attach the accessories on the house construction members, and c) numerous assorted color erasable markers.

2. The playhouse kit of claim 1, wherein the numerous magnetic accessories comprises seasonal accessories including Christmas, Halloween, Easter, Summer, Fall, Winter and Spring accessories.

* * * * *